US008281722B2

(12) United States Patent
Reichel

(10) Patent No.: US 8,281,722 B2
(45) Date of Patent: Oct. 9, 2012

(54) SOLID TRACK COMPRISING A CONCRETE STRIP

(75) Inventor: Dieter Reichel, Neumarkt (DE)

(73) Assignee: Max Bogl Bauunternehmung GmbH & Co. KG, Sengenthal (DE)

( * ) Notice: Subject to any disclaimer, the term of this patent is extended or adjusted under 35 U.S.C. 154(b) by 410 days.

(21) Appl. No.: 12/523,221

(22) PCT Filed: Jan. 7, 2008

(86) PCT No.: PCT/EP2008/050086

§ 371 (c)(1),
(2), (4) Date: Jul. 15, 2009

(87) PCT Pub. No.: WO2008/087061

PCT Pub. Date: Jul. 24, 2008

(65) Prior Publication Data

US 2010/0065651 A1 Mar. 18, 2010

(30) Foreign Application Priority Data

Jan. 17, 2007 (DE) ..... 10 2007 003 351

(51) Int. Cl.
*B61B 12/04* (2006.01)
*E01B 1/00* (2006.01)

(52) U.S. Cl. ..... 104/124; 238/7

(58) Field of Classification Search ..... 238/2, 3, 238/5–7, 264, 269, 283, 382; 104/124, 125
See application file for complete search history.

(56) References Cited

U.S. PATENT DOCUMENTS 4,728,032 A * 3/1988 Beigl et al. ..... 238/382
5,163,614 A * 11/1992 Tamas et al. ..... 238/2
5,435,486 A * 7/1995 Gerlach et al. ..... 238/7
5,782,405 A * 7/1998 Vincent ..... 238/2

FOREIGN PATENT DOCUMENTS

CH 599 399 5/1978

(Continued)

OTHER PUBLICATIONS

German Patent Office Search Report, Aug. 10, 2007.

(Continued)

*Primary Examiner* — S. Joseph Morano
*Assistant Examiner* — R. J. McCarry, Jr.
(74) *Attorney, Agent, or Firm* — Dority & Manning, P.A.

(57) ABSTRACT

The invention relates to a solid track comprising a concrete strip on a supporting structure that consists of individual, successively arranged segments (2) and comprising rails (6) for a rail-guided vehicle that are located on the concrete strip. The concrete strip is continuous and spans the individual segments (2) and an anti-friction layer (10) is located between the concrete strip and the segments (2). The solid track according to the invention is characterized in that the concrete strip is a profiled concrete strip (7), in which the course of the solid track in terms of curvature and lateral inclination are reflected and in that in the region of adjacent end faces (13) of two neighboring segments (2), the track is equipped with a device (200) that spans both end faces (13) and absorbs any alteration in the position of the adjacent end faces (13). This prevents the forces acting on the profiled concrete strip (7) from having a critical effect and does not impair the action of the anti-friction layer (10).

15 Claims, 4 Drawing Sheets

FOREIGN PATENT DOCUMENTS

| | | | |
|---|---|---|---|
| DE | 14 59 714 | | 12/1963 |
| DE | 24 43 770 | | 3/1976 |
| DE | 25 43 243 | | 3/1977 |
| DE | 30 12 867 | A1 | 10/1981 |
| DE | 39 19 833 | A1 | 12/1990 |
| DE | 196 20 731 | A1 | 11/1997 |
| DE | 198 06 566 | A1 | 8/1999 |
| DE | 19806566 | A1 * | 8/1999 |
| DE | 10 2005 032 912 | A1 | 1/2007 |

OTHER PUBLICATIONS

International Preliminary Report on Patentability, Aug. 20, 2009.
PCT Search Report, May 30, 2008.

* cited by examiner

SOLID TRACK COMPRISING A CONCRETE STRIP

FIELD OF THE INVENTION

The present invention relates to a solid track with a concrete strip resting on a structure consisting of individual segments placed next to each other with rails for a rail-guided vehicle, arranged on a continuous concrete strip that runs continuously and spans the individual segments. An anti-friction layer is arranged between the concrete strip and the segments.

BACKGROUND

Solid tracks are used for high-speed railroad traffic routes or freight traffic and high-load railroad traffic routes, for example. Generally, a concrete strip built for these purposes consists of pre-cast concrete units placed next (and attached) to one another, made of an in-situ cast concrete layer or a combination of the in-situ cast concrete and the pre-cast concrete units. The concrete strip is erected on bridges made from one structure, which in turn is made up of individual segments placed next to one another. Thus, the concrete strip spans the individual segments and supports the rails for a rail-guided vehicle. To prevent stresses between the concrete strip and the segments (caused by thermal expansion, for example), an anti-friction layer has been placed between the concrete strip and the segments. As a rule, the concrete strip has a largely rectangular cross section. The rail-supporting points on which the rails are arranged are located on the concrete strip with the corresponding elevation or curvature depending on the requirements of the course of the track. Therefore, the rail-supporting points must be arranged individually or on a concrete strip, something that demands a great deal of building effort.

The weak point of the concrete strip is the region where the segments of the understructure vibrate. If the segments change position, forces acting against the concrete strip can be generated that could then destroy the concrete strip, or at least inadmissibly displace the rail-supporting points placed on top of it.

Therefore, DE 103 33 616 A1 suggests separation layers for bridge building, arranged between a track bed and a protective material of a longitudinal beam section of a bridge. In this case, the separation layers are located within a rigid lubricating layer and stretch a little bit from a supporting axis of the longitudinal beam towards its internal side. This arrangement allows the compensation of the longitudinal beam's terminal tangent angle, which can result from kinking or shifting in transverse joints.

The disadvantage of this design is that the track bed is not supported over a relatively long distance and therefore it must be either very massively supported in this region or the supporting force of the track bed must be severely limited. Another disadvantage is that the manufacturing of the cantilevered track bed with in-situ cast concrete is very expensive. Finally, since separation layers are incorporated into the lubricating layer, the latter must be thick enough to allow the acceptance of a sufficiently thick separation layer. Furthermore, this design does not foresee the separation layers to absorb pressures owing to their arrangement in the bearing axis. In the region where two longitudinal beams bump into one another, the separation layers can only absorb reliefs but not loads that would be generated by a change in the position of the longitudinal beams.

Therefore, an object of this invention is to manufacture a solid track with a concrete strip in an economical and reliable way without too much difficulty that will also remain stable on a critical substructure and can be reliably operated.

SUMMARY

The object is solved with a solid track that has a concrete strip structure made up of individual segments placed next to each other that has the characteristics as described and claimed herein. Objects and advantages of the invention will be set forth in part in the following description, or may be obvious from the description, or may be learned through practice of the invention.

An important aspect of the solution according to the invention on a rigid substructure is the fact that a continuous anti-friction concrete strip is used that absorbs all forces acting upon it and diverts them into the segments in a stable and lasting way. In the conventional systems, on the other hand, only the rail runs continuously over the structures. Thus, the rail must absorb all longitudinal forces caused by temperature, brake action, centrifugal forces, deformations, settling of the segments, etc., which can easily lead to excessive stress and breaking of the rail. The continuous anti-friction concrete strip takes the stress off the rail, thus making this solution significantly safer and more economical.

Since according to the invention, the solid track concrete strip constitutes a strip that runs continuously over at least two segments, the expansion joint between both segments is not taken into account for the course of the concrete strip. Owing to the large mass of the segment compared to the concrete strip and to the direction of the heat irradiation, the concrete strip is exposed to much larger than usual thermal expansions than the segment itself, and the latter expands much more slowly as a result of heat than the concrete strip, so a design according to the invention was created that makes the segments independent from the concrete strip. In this design, the concrete strip is executed in the shape of profiled, continuous concrete and an anti-friction layer is placed between the profiled concrete and the segment. In this way, it is possible for the concrete strip or profiled concrete to slide over the segment and thermal expansions can take place mostly independently from one another. The profiled concrete spans the impacts or the neighboring frontal sides of the individual segments placed next to one another. This arrangement creates a solid track that can also be continuously built over the region of a segmented substructure prone to impacts. As a result of this, the solid track can be built economically and is also more comfortable to drive on than before.

The course of the solid track with regard to curvature and transverse gradient is shown in the profiled concrete. Because of this, the profiled concrete has different cross sections to raise the route when in sections with curves. The rail-supporting points for bedding the rails can then be very easily and in most cases executed as identical parts attached onto the profiled concrete. A fast, economical and very precise building of the track substructure is therefore possible.

In the area of the neighboring front sides of two segments placed next to one another, a device spanning both front sides has been arranged for absorbing a change of position of the neighboring front sides. This device prevents a critical force to act on the profiled concrete without significantly interfering with the effect of the anti-friction layer. The device spans the front sides of the segments placed next to one another and can therefore not only function as a force absorber but also as a shuttering element for the making of the profiled concrete from in-situ cast concrete. If the segments displace with respect to one another—especially with regard to the tangential angle—the end of a segment presses into the device and prevents a critical force to be transferred to the profiled concrete, which must therefore not be placed for having to absorb a high force that starts at the ends of the segments. It can be executed in a relatively thin way if it can be ensured that the device will absorb the force expected to act on it. This leads to definite savings because less concrete is needed and the route can be finished sooner. In addition, the profiled concrete must not be reinforced with an additional continuous concrete strip (such as with a layer of interconnected plates made of pre-cast concrete units) because it is strong enough in spite of its relatively thin construction owing to the fact that the device intercepts the forces originating in the segments.

Furthermore, if the device is capable not only of horizontally absorbing the forces coming from below that act on the profiled concrete, but also the forces generated by a sliding movement of the segments towards the profiled concrete, then the mobility of the profiled concrete on the segments is maintained and the unacceptable stresses that can lead to changes in rail position are reliably prevented.

In a preferred design of the solid track according to the invention, the segment is supported by a fixed bearing and a floating bearing, and the profiled concrete in the region of the fixed bearing of the segment is firmly attached to it. As a result of this, the different expansions of solid track and profiled concrete with regard to the segment are influenced in such a way that the expansions occur largely in the same direction. Thus, the relative movements of both units towards one other remain relatively small.

Particularly advantageous is the creation of a solid segment-profiled concrete connection with connecting elements such as anchors (especially screw-down anchors, stirrup reinforcements or plugs) that protrude from the segment, for example, and on which the profiled concrete is cast. The best results are obtained if the anchors are of the screw-down type so they can be screwed on the segment just before the profiled concrete is cast. This makes it possible for vehicles to be driven over the segment before casting the profiled concrete and without damaging the anchors.

If the segment has been placed in a floating way, and the profiled concrete and the segment are joined together in a sliding way, then both structures are largely uncoupled from one another and can expand without mutual stresses. In this case, the device for absorbing a change in position of the neighboring front sides must be especially capable of not limiting the sliding movement of the segments with respect to the profiled concrete because in this type of bedding, one has to expect the segments to slide more than with a bedding that has one fixed and one floating bearing.

A special advantage is the use of a device for absorbing a change in position with a compliant layer such as rigid foam or an elastomeric layer in the front side region of two segments that is placed between the segments and the profiled concrete. Since the individual segments are independent from one another and—contrary to them—the profiled concrete also runs as a continuous strip over the expansion joints along the front sides of the segments, different bending lines occur in both units. The segments will bend in a curved way while the profiled concrete runs wave-like over the individual segments. To prevent excessive stresses in the region between two segments, a rigid foam layer or an elastomeric layer are provided. In an extreme case, the ends of the segments can move in and out of the compliant layer without exerting an unacceptable pressure force on the profiled concrete. The stress on the continuous strip is hereby reduced. Thus, the compliant layer becomes a very advantageous element in this type of construction. For example, the compliant layer can be made of rigid foam in the form of rigid foam plates and placed on the segments before the profiled concrete is cast. This simultaneously creates a formwork for the profiled concrete in the region of the front sides spaced apart from each other of two neighboring segments. Here, the compliant layer is so strong that when the profiled concrete is cast, the forces are absorbed without significant deformation, whereas in a subsequent change of angle, the forces press through the segments or—in a transversal or height displacement—the segments press onto the compliant layer, thus preventing an unacceptable force acting on the profiled concrete. Styrodur, for example, is a suitable material that can be used for the rigid foam layer.

If the device on the compliant layer has a supporting plate arranged towards the profiled concrete, then the reinforcement for the profiled concrete can be advantageously laid down on this supporting plate before and during the casting process without damaging the compliant layer or be cast in an undefined way into the profiled concrete.

An advantage of the complaint layer and/or the supporting plate of the device is that it spans both frontal sides of the segments. This should especially ensure that the profiled concrete can be cast in the region of the segment impacts without taking an additional measure.

If the compliant layer reaches at least from the front side of the segment to beyond the longitudinal axis of the segment, then the end of the segment that approaches the profiled concrete changes its position when it is being pressed into the compliant layer. When this occurs, the end of the segment moves around the bearing (especially around the bearing axis) towards the profiled concrete. The compliant layer consequently protects the profiled concrete from damage.

If a recess has been made in the segment and/or in the profiled concrete for at least the partial acceptance of the compliant layer, then, on the one hand, the position of the layer is defined and, on the other hand, if arranged on the segment, the profiled concrete near the compliant layer is not particularly weakened. Therefore, in the region of the transition of one segment to another, the height of the profiled concrete is almost the same as the thickness in the remaining stretch of the profiled concrete. If the compliant layer has been arranged on the profiled concrete, then no special recess must be provided for the segments and their construction is facilitated. Additionally, the segments do not weaken, and this can be especially advantageous when the segments are merely plates that can be laid horizontally on the ground or on supports. Both of these solutions ensure above all that the sliding movement of the segments with regard to the profiled concrete will not be hindered. If the weakening of segment and profiled concrete must be uniformly low, then the device can be arranged with the compliant layer on both sides, the side of the profiled concrete and the side of the segment.

The sliding layer between the profiled concrete and segment is advantageously made from a foil and/or a geotextile. Even the use of two foils lying on top of each other so they can slide past each other in a defined way is advantageous. The geotextile has the advantage that it is at least partly impregnated with the concrete, thus combining very well with it. Uneven sections of the segment can be leveled out with the geotextile, which can have a thickness of 2-10 mm. As a result of this, the profiled concrete slides much better on the segment and stresses are largely avoided. To accomplish this, a geotextile layer can be arranged on the segment and/or on the side of the profiled concrete that faces the segment. The layer can have one or two foils, for example of PE with a thickness of 0.3-0.5 mm.

It is especially advantageous for the invention if many rail-supporting points are arranged on or in the profiled concrete. In this arrangement, the rails are discontinuously attached above the rail-supporting points on or in the profiled concrete. The course of the rails is already given by the corresponding shape of the profiled concrete adapted to the course of the track. Thus, the rails can be laid in a very short time. Alternatively, the rails can be laid continuously too; the respective rail receptacles (such as troughs, for example) can already be foreseen in the shape of the profiled concrete.

It is advantageous for the rail-supporting points to be poured in or bolted in place as pre-cast concrete units in the profiled concrete. The contours for receiving the rails and their fastening elements can already be provided in the pre-cast concrete units; especially suitable for rail-supporting points are individual units per support, cross ties, longitudinal ties, two-block ties, railroad tracks and/or plates or rail-supporting points placed on top. The individual parts are not coupled to one another but lie separate from one another in or on the profiled concrete to avoid extra laying work. However, a coupling of the individual structural parts cannot be ruled out if it proves advantageous for a particular task of the construction project.

Apart from the advantages mentioned above, the profiled concrete also has the advantage that the routing of the solid track can be executed with the profiled concrete. An excess height of the routing, especially in sections with curves, is shaped with the help of the profiled concrete. The structural parts that have the rail-supporting points can then always be laid in the same design. Special dimensions are generally not needed.

To obtain a stable profiled concrete capable of absorbing pressure and tensile stresses caused by thermal expansion and acceleration forces of the rail-guided vehicles, it must be reinforced.

So that the profiled concrete and the solid track do not especially break open on the sides, stoppers may be arranged on the segment for lateral and/or vertical guidance. The stoppers allow a relative movement of the profiled concrete in longitudinal and/or vertical direction of the rails. A lateral movement of the profiled concrete on the segments is prevented by the stoppers arranged on both sides of the profiled concrete.

If the device creates a formwork for making the profiled concrete between two neighboring segments, then extra formwork elements are generally not needed.

The segments can be laid elevated or at ground level so they can be used not only as bridge-building parts but also for ground-level spanning of a substructure insufficiently capable of supporting a load. Such an installation is more economical than the preparation of the substructure. It is best for the segments to be bridge girders, plates placed on a subsurface or pole head plates.

BRIEF DESCRIPTION OF THE DRAWINGS

Additional advantages of the invention are described in the following execution examples, which show.

DESCRIPTION

Figure 1:
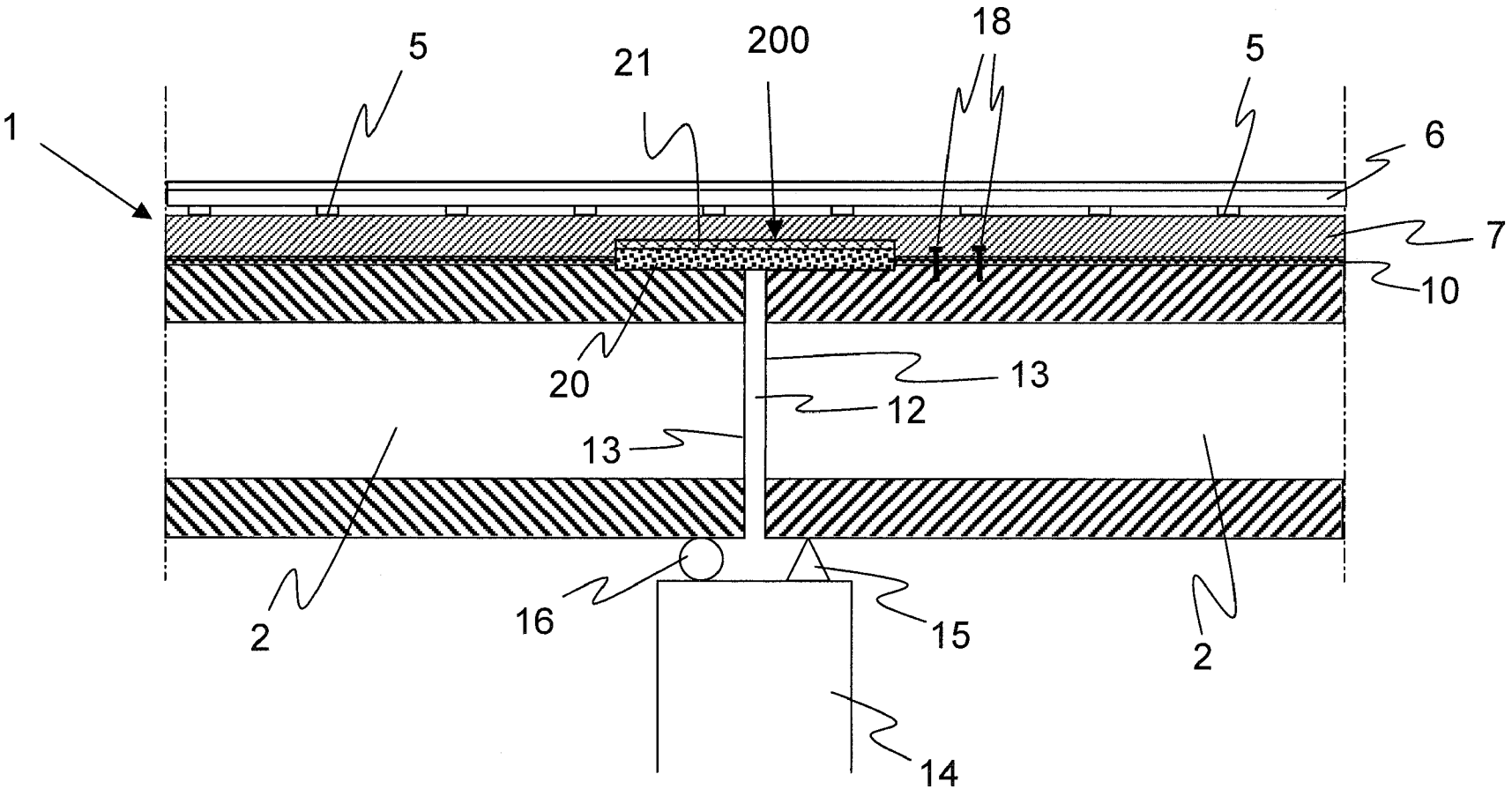
FIG. 1 a longitudinal view of a solid track on a bridge construction in the frontal region of two bridge segments.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

FIG. 1 shows a longitudinal section through a solid track 1 in the region of a joint 12 on the front sides 13 of two segments 2 of a bridge. In this embodiment example, the solid track 1 consists of a continuous strip of profiled concrete 7 made from pre-cast in situ concrete. Rails 6 have been laid on rail-supporting points 5 along the solid track 1. The rail-supporting points 5 have been arranged on the profiled concrete 7 and can be shaped in such a way that they support the rails 6 discontinuously, as shown here. However, a continuous support of the rails 6 is also possible if the rail-supporting points 5 run along the rails 6. Consequently, the profiled concrete 7 constitutes a solid, immobile and uniform substructure for the rail-supporting points 5 for the long-term operation of the solid track 1.

A non-friction layer 10 has been placed between the profiled concrete 7 and the upper side of the segment 2. So different expansions caused especially by sun radiation and the different masses of segment 2 and the solid track 1 that act on the profiled concrete 7, it is essential for the solid track 1 and the profiled concrete 7 to slide on the segment 2. As a result of this, unacceptable stresses are prevented and a very constant structure is created (particularly in the region of the solid track 1) that considerably increases the riding comfort of the rail-guided vehicle and can also be built relatively economically.

In the detail shown here, the segments 2 have been arranged on a pole 14, supported by a fixed bearing 15 and a floating bearing 16. Thus, the longitudinal expansion of segment 2 starting from the fixed bearing 15 towards the floating bearing 16 of the same segment 2 takes place, causing the gap in joint 12 to become smaller or wider, depending on the longitudinal expansion of segment 2. So the shearing forces from the solid track 1 and the profiled concrete 7 can be transferred to the segment 2, anchors 18 have been placed near the fixed bearing 15 of the segment 2 to connect the profiled concrete 7 with the segment 2. Because of this, the thermal expansions of the profiled concrete 7 and of the segment 2 are also given the same direction so that a slower relative movement of both units is expected.

The anchors 18 are preferably of the screw-down type. This means that on the upper side of the segments 2, screw-down covers have been set in concrete in which the anchors 18 have been screwed down just before casting the profiled concrete 7. This has the advantage that construction vehicles can be driven on the upper side of the segments 2 while the structure is being built without damaging the anchors 18, which otherwise would protrude from the upper side of the segment 2.

Since the segments 2 are not linked to each other, they will bend through like arches under load. Contrary to this, the movement of the continuous strip of the profiled concrete 7 and of the solid track 1 will be more wave-like. To prevent an unacceptable kink of the continuous strip near the frontal sides 13, a device 200 spanning both frontal sides 13 has been arranged for absorbing a change in position of the neighboring frontal sides 13. The device 200 consists of a rigid foam layer 20 arranged near the joint 12. In this embodiment example, the rigid foam layer 20 is located between the segments 2 and the profiled concrete 7, reaching partly into them. Therefore, a kink that could possibly occur between two segments 2 near the joint 12 does not press against the profiled concrete 7 but moves into the rigid foam layer 20 and compresses it without exerting an unacceptable pressure force on the profiled concrete 7. The rigid foam layer 20 can be made of hard foam plates placed into a recess of segment 2 intended for this purpose. It is usually enough for the rigid foam layer 20 to have a thickness of a few centimeters. Likewise, an overlapping of the front sides 13 on a length of 1 to 2 m is also sufficient for compensating the expected vertical relative movements of the profiled concrete 7 and the segments 2. Although the indentation in the upper side of the segment 2 for receiving the rigid foam layer 20 has a manufacturing advantage because the position of the rigid foam layer 20 is safely maintained when casting the profiled concrete 7, it is not essentially required for functional purposes.

So that during casting of the profiled concrete 7 the position of the reinforcement located therein and—especially in the case of wider spacing between the segments 2—the casting of the profiled concrete 7 without additional formwork materials can be ensured, it is advantageous for the device 200 on the rigid foam layer 20 to have a supporting plate 21. The supporting plate 21 ensures that the reinforcement will not sink into the rigid foam layer 20 during casting but will maintain a pre-determined separation in the process. The reinforcement can correspondingly find support on the supporting plate 21, for example with legs arranged on it.

Figure 2:
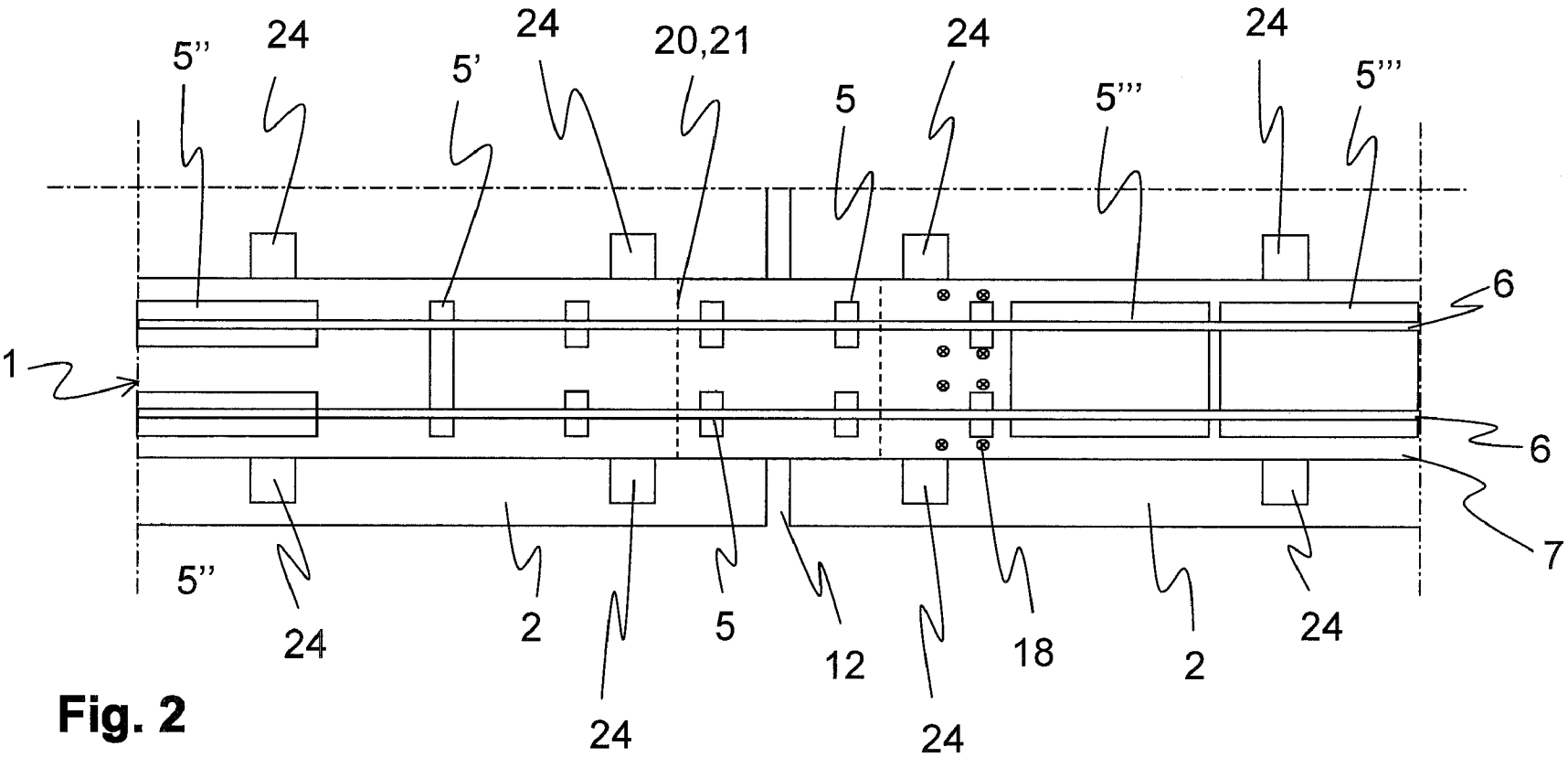
FIG. 2 a top view of a solid track in a region as shown in FIG. 1.

FIG. 2 shows a top view of the segments 2 of a solid track 1 near the joint 12 of two segments 2, from which it becomes apparent that the profiled concrete 7 forms a continuous strip that runs above the front sides 12 of two segments 2. Near the joint 12, the rigid foam layer 20 and the supporting plate 21 have been incorporated. Likewise, the anchors 18 are provided in this region to link the profiled concrete 7 with the segment 2. The rails 6 of the track line for the rail-guided vehicle have been laid on numerous rail-supporting points 5. Depending on the rail-laying system, this can also be done differently. Thus, instead of a discontinuous rail-support, a continuous one is possible—as hinted at by the longitudinal ties 5". It is even possible for the solid track 1 to consist of individual cross ties 5' that support the rails 6 and are connected to each other with concrete and reinforcement. Two-block ties, a track grid and/or plates (5'") are other ways in which the rail-supporting points can be made from pre-cast concrete units. Optionally, the rail-supporting points can also be made from in-situ cast concrete.

At any rate, it is essential to build a continuous strip along the solid track that will be independently and continuously developed from the joint 12.

Stoppers 24 are provided for ensuring a uniform position of the solid track 1 with respect to the transversal orientation towards the segment 2. These stoppers 24 are fastened onto the segment 2 and guide the solid track 1 and the profiled concrete 7 in transversal direction. The contact point to the solid track 1 or to the profiled concrete 7 is loose, so that distortions can be prevented in a longitudinal expansion. Therefore, it can be advantageous to place an anti-friction layer between the stopper 24 and the profiled concrete 7 as well.

Figure 3:
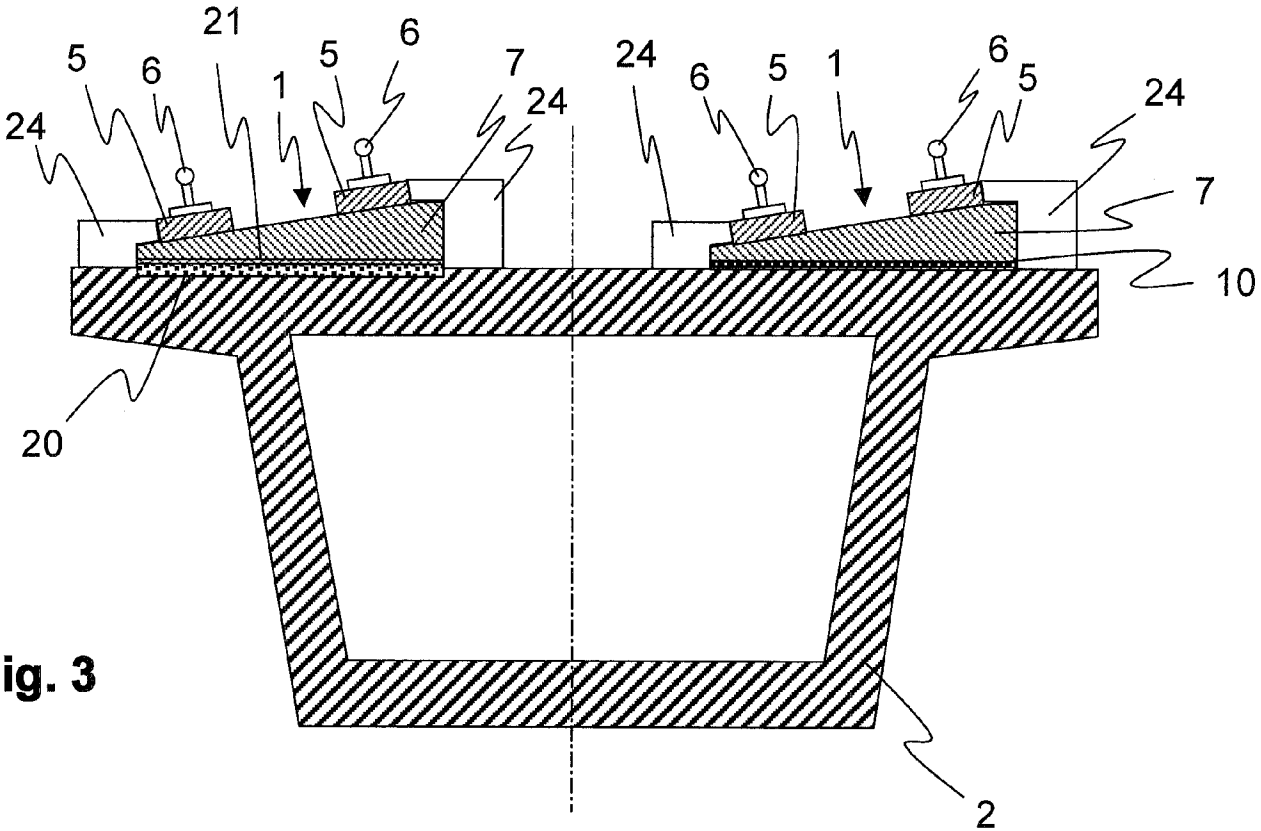
FIG. 3 a cross section through a bridge segment.

FIG. 3 shows a cross section through the structure according to the invention, where on the left side of the drawing a cut through a segment 2 and the solid track 1 in the region of a front side 13 of a segment 2 can be seen. This explains why the rigid foam layer 20 and the supporting plate 21 can be seen under the profiled concrete 7, which is wedge-shaped to lift the solid track 1. This is especially required in curved sections of the solid track 1 route. The elevation is done with the help of the profiled concrete 7, cast in concrete if needed. For the lateral guidance of the solid track 1 and of the profiled concrete 7, stoppers 24 have been arranged on the sides. The stoppers 24 are, on the one hand, firmly attached to segment 2 and, on the other hand, the profiled concrete 7 can slide along the stoppers 24.

The right half of FIG. 3 shows a cross section in the region of the normal route, off joint 12. The anti-friction layer 10 has been placed between the segment 2 and the profiled concrete 7 to allow the profiled concrete 7 to slide over the segment 2. Moreover, this drawing corresponds to the one on the left side of FIG. 3.

Figure 4:
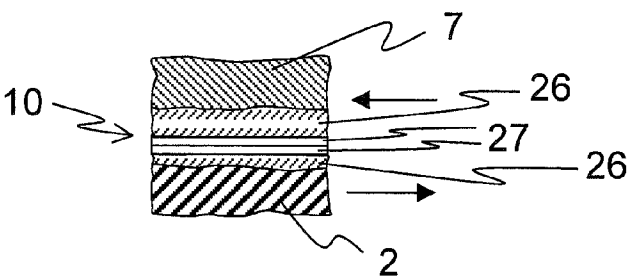
FIG. 4 a section showing a detailed view of the anti-friction layer.

FIG. 4 shows a detail of the sliding connection between profiled concrete 7 and segment 2. So the rough surfaces of segment 2 and the profiled concrete 7 can be made to slide without creating a lot of resistance in the process, in this embodiment it is provided that a geotextile 26 is placed on the upper side of segment 2 and also on the underside of the profiled concrete 7. There are two foils 27 between the geotextiles 26, which smooth out the uneven surfaces of segment 2 and the profiled concrete 7. During casting, the geotextiles 26 are partly impregnated with the respective concrete when they are applied before the concrete has set. Usually, however, the geotextile 26 is applied only after the concrete has been set, so in this case, the geotextile 26 is not impregnated. On the other hand, the profiled concrete 7 is usually cast on top of the geotextile 26, so it penetrates into the geotextile 26 during the casting process, thereby creating a solid attachment. The two foils 27 allow the profiled concrete 7 to slide on the segment 2, a movement that produces very little friction. Both foils 27 slide past each other without significant resistance. In a simpler embodiment of the invention, only one foil 27 suffices (and possibly even the use of only one geotextile 26) for smoothing out the uneven surfaces of segment 2 and profiled concrete 7 to allow a sufficient sliding effect.

Figure 5:
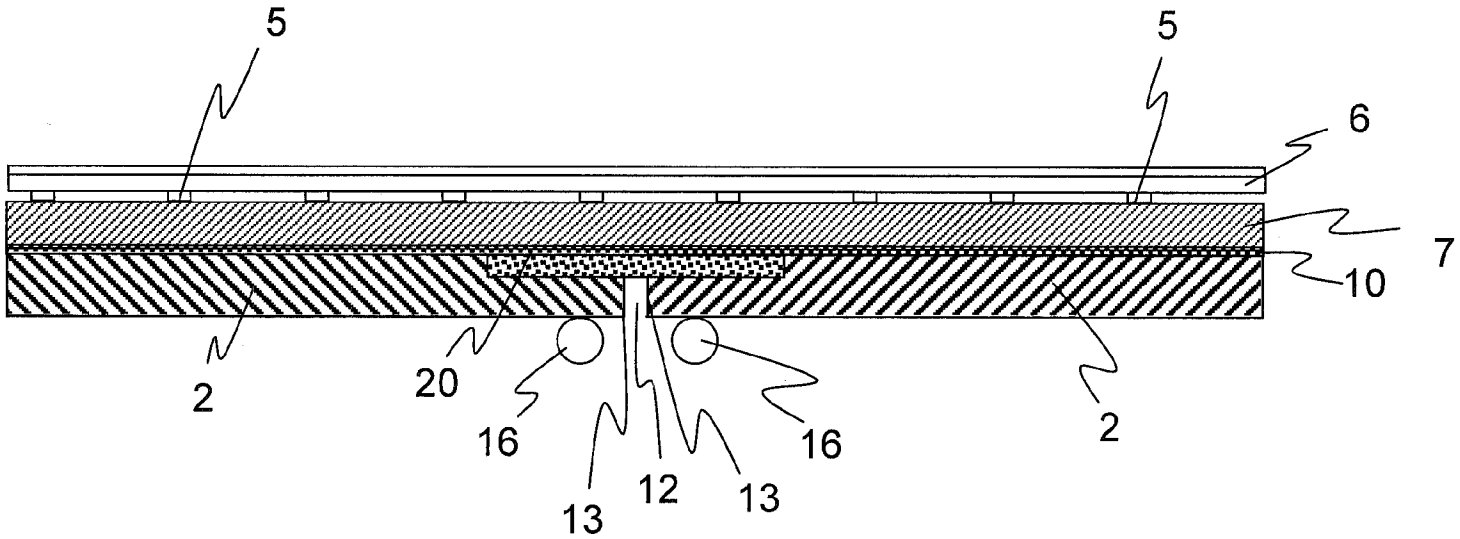
FIG. 5 a longitudinal section through an embodiment of a solid track.

FIG. 5 shows another embodiment of the invention, in which the profiled concrete 7 has not been interrupted by a notch for the rigid foam layer 20, which runs above the joint 12 of both segments 2 without changing the cross section. The anti-friction layer 10 has also been placed continuously and without recess between the profiled concrete 7 and the segments 2 or the rigid foam layer 20. As a result of this, the segments 2 can slide smoothly below the profiled concrete 7. The rigid foam layer 20 has been placed in a recess in the respective ends of the segments 2. It reaches from a region before the support of the first segment 2, passes over its front side 13 and the joint 12, and continues all the way to above the front side 13 and the support of the second segment 2. The stability of the segments 2 is affected only marginally by this. In this arrangement, the rigid foam layer 20 spans over the joint 12 and also serves as formwork for the profiled concrete 7 made with in-situ cast concrete. This can be done without a supporting plate 21 as long as the joint 12 has a slight width or the rigid foam layer 20 has been made sufficiently stable. In this embodiment, both segments 2 float, and this is hinted at by the two floating bearings 16, on which the segments 2 have been placed. Thermal expansions or movements of the substructure under the segments 2 can therefore be uncoupled very well by the profiled concrete 7.

Figure 6:
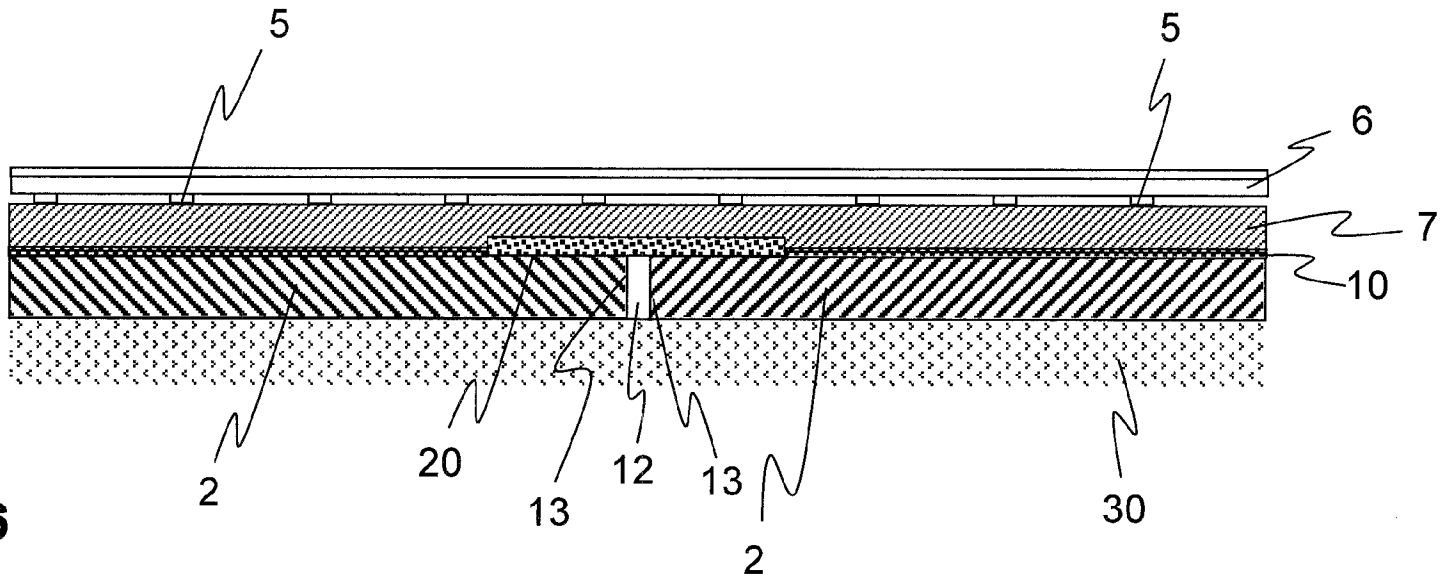
FIG. 6 a longitudinal section through another embodiment of a solid track.

FIG. 6 shows an embodiment in which the rigid foam layer 20 has been placed on the segments 2 and extends into the profiled concrete 7. No special measures for accepting the rigid foam layer 20 must be taken in this embodiment; the profiled concrete 7 must be placed so its strength can accept the forces expected in the region of the rigid foam layer 20. The anti-friction layer 10 is interrupted near the rigid foam layer 20. In this case, the movement between profiled concrete 7 and the segments 2 is compensated by the rigid foam layer 20 as long as the latter does not move towards the segments together with the profiled concrete 7. If difficulties are expected here, one can also execute the anti-friction layer 10 continuously and place the rigid foam layer 20 on the continuous anti-friction layer 10.

The embodiment example of FIG. 6 also shows the position of the segments 2 on a substructure 30. The segments 2 have been executed as plates placed on the substructure 30. This substructure 30 can be a hydraulically-bonded supporting layer or another surface prepared in a more or less time-consuming way.

This invention is not limited to the embodiment examples shown. Within the scope of the patent claims, the form of the profiled concrete 7, the segment 2, and the anti-friction layer 10 can vary at any time.

It should be appreciated by those skilled in the art that various modifications and variations may be made present invention without departing from the scope and spirit of the invention. It is intended that the present invention include such modifications and variations as come within the scope of the appended claims.

The invention claimed is:

1. A solid track structure for a rail-guided vehicle, said structure comprising:

at least two adjacently disposed individual segments with a space between facing front sides of said segments;

a continuous concrete strip spanning said segments and disposed continuously along the length of said segments;

an anti-friction layer disposed between said concrete strip and said segments for relative sliding movement between said concrete strip and said segments;

rails configured on an upper surface of said concrete strip for guidance of a rail-guided vehicle;

said continuous concrete strip comprising a transverse profile with a curvature and gradient that define a course of said solid track; and a spanning device disposed on said segments so as to span said space between said facing front sides, said spanning device formed of a material suited for absorbing a relative positional change between said segments to prevent forces from a positional change of the segments from acting on said continuous concrete.

2. The solid track structure as in claim 1, wherein each of said segments rest on a fixed bearing at one front side and a floating bearing at the opposite front side, said continuous concrete strip rigidly attached to said segment in close proximity to said fixed bearing.

3. The solid track structure as in claim 1, further comprising anchors set in said segments for attaching said continuous concrete strip to said segments.

4. The solid track structure as in claim 1, wherein said spanning device comprises a complaint material layer disposed between said continuous concrete layer and said segments.

5. The solid track structure as in claim 4, further comprising a supporting plate configured on said compliant material layer.

6. The solid track structure as in claim 5, wherein said supporting plate and said compliant material layer longitudinally span said segments so as to extend beyond bearing axis points of said segments adjacent to said space.

7. The solid track structure as in claim 4, wherein said compliant material is set into recesses defined in said segments.

8. The solid track structure as in claim 1, wherein said antifriction layer comprises at least one foil and a geotextile material.

9. The solid track structure as in claim 1, wherein said rails are supported by a plurality of spaced-apart supporting points configured on or in said continuous concrete strip.

10. The solid track structure as in claim 9, wherein said supporting points comprise preformed concrete units set into or bolted to said continuous concrete strip.

11. The solid track structure as in claim 9, wherein said supporting points comprise any combination of individual support structures for each rail, cross tie support structures that span between said rails, plate support structures that span between said rails, or continuous individual longitudinal supports for each rail.

12. The solid track structure as in claim 1, wherein said continuous concrete strip is reinforced.

13. The solid track structure as in claim 1, further comprising stoppers configured on said segments against lateral sides of said continuous concrete strip for transverse or vertical guidance of said continuous concrete strip relative to said segments.

14. The solid track structure as in claim 1, wherein said spanning device defines a formwork for formation of said continuous concrete strip between said segments.

15. The solid track structure as in claim 1, wherein said segments comprise any one of bridge girders, plates placed on a subsurface, or pole head plates.

* * * * *